US006848441B2

(12) United States Patent
Bachinski et al.

(10) Patent No.: US 6,848,441 B2
(45) Date of Patent: Feb. 1, 2005

(54) APPARATUS AND METHOD FOR COOLING A SURFACE OF A FIREPLACE

(75) Inventors: Thomas J. Bachinski, Lakeville, MN (US); Gary Lee Butler, Silver Lake, MN (US); Emadeddin Y. Tanbour, Muscatine, IA (US); Thomas Alfred Early, Hager City, WI (US); Timothy Wayne Johnson, Janesville, MN (US); David Charles Lyons, Red Wing, MN (US); Robb Edward Bennett, Prior Lake, MN (US)

(73) Assignee: HON Technology Inc., Muscatine, IA (US)

( * ) Notice: Subject to any disclaimer, the term of this patent is extended or adjusted under 35 U.S.C. 154(b) by 0 days.

(21) Appl. No.: 10/285,379

(22) Filed: Oct. 30, 2002

(65) Prior Publication Data

US 2004/0011348 A1 Jan. 22, 2004

Related U.S. Application Data

(63) Continuation-in-part of application No. 10/199,982, filed on Jul. 19, 2002, now abandoned.

(51) Int. Cl.[7] ..... F24C 5/00; F23M 7/00

(52) U.S. Cl. ..... 126/512; 126/198; 126/528; 126/531

(58) Field of Search ..... 126/190, 193, 126/198, 200, 77, 78, 508, 512, 19 R, 528, 529, 544, 547, 531; 431/125

(56) References Cited

U.S. PATENT DOCUMENTS

| | | | | | |
|---|---|---|---|---|---|
| 2,747,568 | A | * | 5/1956 | Dupler | 126/531 |
| 2,794,434 | A | | 6/1957 | Evans | |
| 3,489,135 | A | * | 1/1970 | Astrella | 126/198 |
| 3,616,788 | A | | 11/1971 | Hannebaum | |
| 3,889,099 | A | * | 6/1975 | Nuss | 219/393 |
| 4,033,321 | A | * | 7/1977 | Krebs | 126/198 |
| 4,282,855 | A | | 8/1981 | Perry | |
| 4,304,216 | A | | 12/1981 | Ratelband | |
| 4,412,524 | A | | 11/1983 | Ratelband | |
| 4,412,525 | A | | 11/1983 | Aidla | |
| 4,519,377 | A | | 5/1985 | Taylor | |
| 4,541,408 | A | | 9/1985 | Ratelband | |
| 4,607,612 | A | * | 8/1986 | DeRisi | 126/508 |
| 4,616,628 | A | | 10/1986 | Ratelband | |
| 4,686,891 | A | * | 8/1987 | Pouchard | 454/256 |
| 5,337,727 | A | * | 8/1994 | Borens et al. | 126/200 |
| 5,339,797 | A | | 8/1994 | Maitland | |
| 5,542,407 | A | * | 8/1996 | Hawkinson | 126/77 |

FOREIGN PATENT DOCUMENTS

| | | | | |
|---|---|---|---|---|
| CA | 1125607 | * | 6/1982 | 126/200 |
| JP | 1-306769 | * | 12/1989 | |

* cited by examiner

*Primary Examiner*—James C. Yeung
(74) *Attorney, Agent, or Firm*—Merchant & Gould P.C.

(57) ABSTRACT

A fireplace including a combustion chamber enclosure with an opening and an inner pane positioned to at least partially cover the opening of the combustion chamber. An outer pane is spaced apart from the inner pane, the outer pane and the inner pane creating a space through which air moves, the air cooling the outer pane. A blower may be provided to move the air through the space. The outer pane may be angled with respect to the inner pane to enhance air movement.

11 Claims, 10 Drawing Sheets

APPARATUS AND METHOD FOR COOLING A SURFACE OF A FIREPLACE

RELATED APPLICATION

This is a continuation-in-part of U.S. patent application Ser. No. 10/199,982, filed Jul. 19, 2002 now abandoned, which is hereby incorporated by reference herein in its entirety.

TECHNICAL FIELD

The present invention relates to fireplaces. More particularly, the invention relates to an apparatus and method for cooling a viewing surface of a fireplace.

BACKGROUND

Fireplaces have become increasingly commonplace in homes, businesses, and other buildings. A fireplace provides benefits including the generation of heat as well as an aesthetically-pleasing arrangement of flames, sounds, and smells. A fireplace is typically mounted in a wall of a structure and may include one or more exposed surfaces.

However, the exposed surfaces of the fireplace can create safety issues. For example, because the fireplace produces heat, it is possible for one or more of the exposed surfaces of the fireplace to become heated. Surfaces of a fireplace that are typically exposed are the viewing surface or surfaces through which the interior of the fireplace is viewed and the surround which surrounds the fireplace.

The exposed surfaces may become hot and pose a risk of burns to individuals or damage to objects that come into contact with the surfaces. Current fireplace design fails to adequately provide an apparatus or method to maintain the viewing surface and surround at a temperature that is safe.

Thus, there is a need for an apparatus and method for cooling a viewing surface and/or surround of a fireplace.

SUMMARY

Generally, the present invention relates to fireplaces. More particularly, the invention relates to apparatus and method for cooling a viewing surface and/or surround of a fireplace.

According to one aspect, the invention relates to a fireplace including a cooling apparatus for cooling a viewing surface of the fireplace, the fireplace including a combustion chamber enclosure defining an opening, an inner pane positioned to at least partially cover the opening of the combustion chamber, an outer pane spaced apart from the inner pane to define a space through which air moves, the space being configured to maximize cooling of the outer pane, and a blower positioned to move the air through the space between the inner pane and the outer pane.

In accordance with another aspect, the invention relates to a fireplace including a cooling apparatus for cooling a viewing surface of the fireplace, the fireplace including a combustion chamber enclosure defining an opening, an inner pane positioned to at least partially cover the opening of the combustion chamber, an outer pane spaced apart from the inner pane to define a space through which air moves, wherein a lower distance between a lower end of the outer pane and a lower end of the inner pane is greater than an upper distance between an upper end of the outer pane and an upper end of the inner pane, and a blower positioned to move the air through the space between the inner pane and the outer pane.

In accordance with yet another aspect, the invention relates to a method for cooling a viewing surface of a fireplace, the method including: providing a combustion chamber enclosure defining an opening; providing an inner pane and an outer pane, the inner pane positioned to at least partially cover the opening of the combustion chamber; positioning the outer pane apart from the inner pane at a distance to maximize cooling of the outer pane, the outer pane and the inner pane defining a space; and moving air through the space between the inner pane and the outer pane.

The above summary of the present invention is not intended to describe each disclosed embodiment or every implementation of the present invention. Figures in the detailed description that follow more particularly exemplify embodiments of the invention. While certain embodiments will be illustrated and described, the invention is not limited to use in such embodiments.

BRIEF DESCRIPTION OF THE DRAWINGS

The invention may be more completely understood in consideration of the following detailed description of various embodiments of the invention in connection with the accompanying drawings, in which.

While the invention is amenable to various modifications and alternant forms, specifics thereof have been shown by way of example and the drawings and will be described in detail. It should be understood, however, that the intention is not to limit the invention to the particular embodiments described. On the contrary, the intention is to cover all modifications, equivalents, and alternatives falling within the spirit and scope of the invention.

DETAILED DESCRIPTION

The present invention relates to fireplaces. More particularly, the invention relates to an apparatus and method for cooling a viewing surface and surround of a fireplace. While the present invention is not so limited, an appreciation of the various aspects of the invention will be gained through a discussion of the examples provided below.

As used herein, the phrase "viewing surface" is any surface through which at least a portion of an interior of a fireplace may be viewed. For example, a viewing surface may consist of a pane of translucent tempered or ceramic glass or high-temperature plastic positioned to cover at least a portion of an opening of a fireplace. The term "surround" means any exposed structural surface that covers the fireplace.

Figure 1:
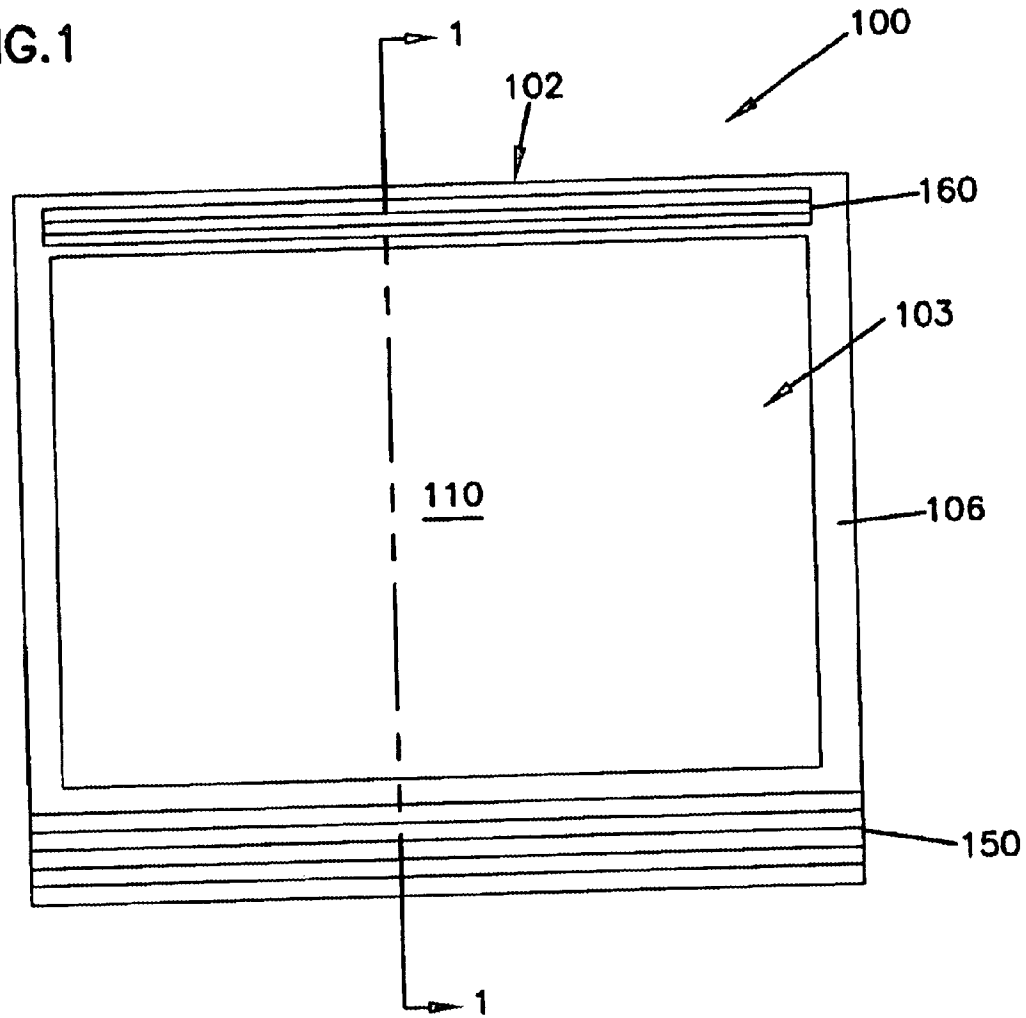
FIG. 1 is a schematic front view of an example embodiment of a fireplace including an example cooling apparatus made in accordance with the present invention.
Figure 2:
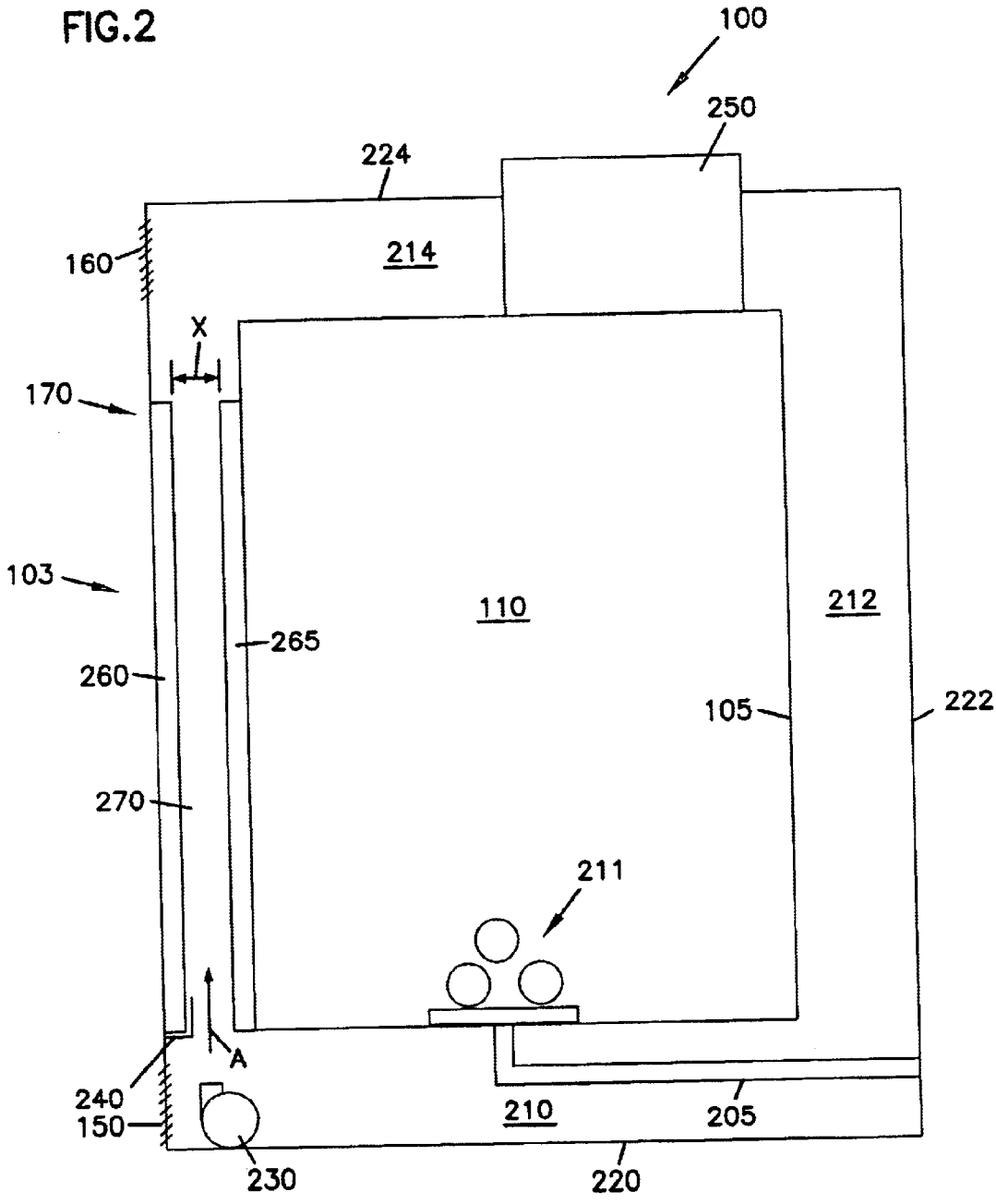
FIG. 2 is a schematic side cross-sectional view of the fireplace of FIG. 1 taken along line 1—1.

Referring now to FIGS. 1 and 2, an example fireplace 100 is illustrated including an outer enclosure 102, a viewing surface 103, a surround 106, grills 150 and 160, and a combustion chamber enclosure 105 defining a combustion chamber 110. The phrase "combustion chamber enclosure" may include any enclosure in which flames and/or heat are generated or simulated. Fireplace 100 may be any type of fireplace, such as, for example, a solid-fuel, gas, or electric fireplace. In the example embodiment, the fireplace 100 is a gas fireplace.

A burner 211 is positioned in the combustion chamber enclosure 105 to combust gas and thereby generates heat. The burner 211 is coupled by a gas line 205 to a source of combustible gas (not shown).

Grills 150 and 160 cover a room air intake and room air exhaust, respectively. Fireplace 100 includes a lower plenum 210, a rear plenum 212, and a top plenum 214 positioned between outer panels 220, 222, and 224 and the combustion chamber enclosure 105. The plenums 210, 212, and 214 are fluidly connected to one another and define a plenum system through which room air may enter the lower plenum 210 through the grill 150, circulate through the rear and top plenums 212 and 214, and exit through the grill 160 back into the room. The room air may be heated as it travels through the plenum system. Disposed within the lower plenum 210 is a blower 230 for blowing room air.

An exhaust 250 exhausts combusted air from the combustion chamber enclosure 105 to the outside.

Fireplace 100 is provided as an example only, and any other known configuration for a fireplace may also be used. For example, the present invention may be used in conjunction with any prefabricated gas fireplace such as, for example, a direct vent, a universal vent, a B-vent, a horizontal/vertical-vent, a dual direct vent, a multisided unit having two or three glass panels as combustion chamber side panels, or in any fireplace unit, stove, or insert that requires a burner. Further, the invention may be utilized in any configuration of a solid-fuel burning or electric fireplace as well.

The fireplace 100 further includes an example cooling apparatus 170 for cooling the viewing surface 103 of the fireplace 100. In addition, the cooling apparatus 170 may also function to cool the surround 106. The example cooling apparatus 170 generally includes an outer pane 260 and an inner pane 265. The panes 260 and 265 may be made of any material that is translucent, such as, for example, tempered or ceramic glass or a high temperature plastic. The inner pane 265 is coupled to an opening of the combustion chamber enclosure 105, and the outer pane 260 is coupled to the outer enclosure 102 by a bracket 240. A space 270 is defined between the outer pane 260 and the inner pane 265. In an example embodiment, a dimension X of the space 270 between the inner pane 265 and the outer pane 260 is between about 1/16 to 3/4 inch. In another embodiment, the dimension X is about 1 inch. Other dimensions, as noted below, are possible. Room air may circulate through the space 270, as describe below.

The fireplace 100 with the cooling apparatus 170 can operate as follows. Combustion occurs within the combustion chamber 110, which generates heat. The heat may warm the various surfaces of the fireplace 100, including the inner pane 265 of the cooling apparatus 170. Room air from the lower plenum 210 is allowed to circulate through the space 270 of the cooling apparatus 170, as indicated by the arrow A. The room air is heated as it moves through the space 270, and the heat is carried by the room air and is exhausted out through the grill 160. The room air moving through the space 270 functions to maintain the outer pane 260 of the cooling apparatus 170 at a temperature that is cooler than the inner pane 265. To enhance the cooling effect on the outer pane 260, a blower 230 is optionally used to push air through the space 270, thereby further cooling the outer pane 260. The blower may optionally include a diffuser plate (not shown) to average out the airflow that is introduced into the space 270.

In this manner, the outer pane 260 may be maintained at a temperature that is cooler than the inner pane 265. The outer pane 260 is preferably maintained at a temperature that is safe for an individual to touch without receiving severe bums. For example, it may be desirable to maintain the outer pane 260 at a temperature not greater than approximately 170 degrees Fahrenheit. In one embodiment, the outer pane is maintained between a temperature of approximately 140 degrees Fahrenheit and 170 degrees Fahrenheit. In the illustrated embodiment, it is possible to cool the outer pane 260 so that the hottest spot on the outer pane 260 is approximately 130 degrees Fahrenheit. The temperature of the outer pane 260 can be varied, as desired.

Figure 3:
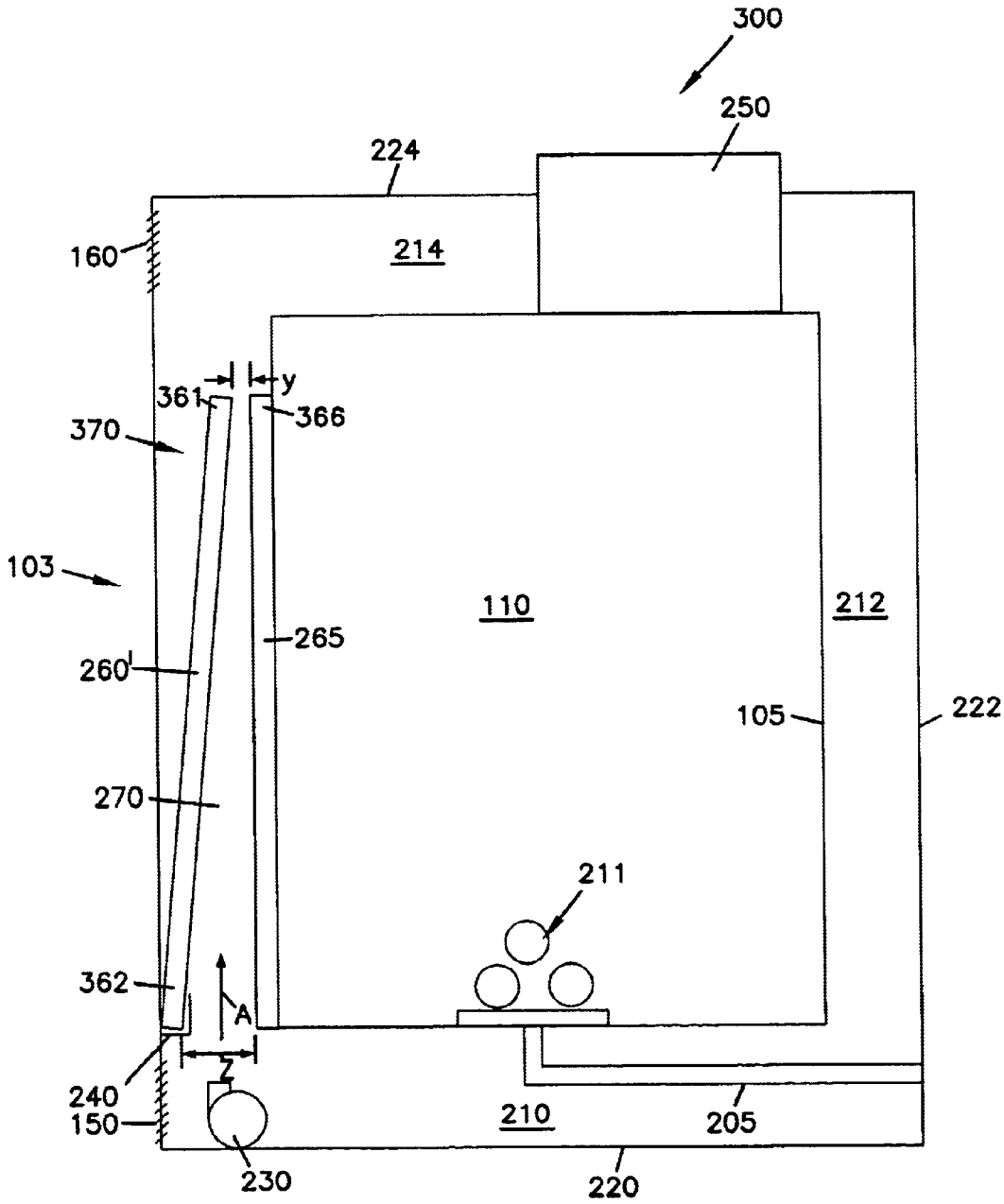
FIG. 3 is a schematic side cross-sectional view of a fireplace including a second embodiment of an example cooling apparatus made in accordance with the present invention.

A second embodiment of an example cooling apparatus 370 is shown in FIG. 3. The cooling apparatus 370 is similar to the cooling apparatus 170, except that the outer pane 260' is positioned at an angle with respect to the inner panel 265 so that a distance Z (a lower distance) between the lower end 362 of the outer pane 260' and the lower end 367 of the inner pane 265 is greater than a distance Y (an upper distance) between an upper end 361 of the outer pane 260' and an upper end 366 of the inner pane 265. In an example embodiment, the distance Y is between about 1/16 and 1/8 inch and the distance Z is between about 5/8 and 3/4 inch. Other dimensions are possible.

It may be preferable to decrease the space 270 at a top portion, as illustrated by the cooling apparatus 370, so that additional air can enter through the larger gap Z, but the smaller gap Y may provide a back pressure on the blower 230 and increase the velocity of the room air flowing through the space 270. The back pressure may allow the room air to move in the direction A up through the space 270, and may further allow air to flow around the sides of the space 270 and circulate back in a direction opposite to the direction A. The room air that circulates back may enter the lower plenum 210 and move through the plenum system via the natural convection of the fireplace 300. The room air that moves upward and downward through the space 270 can therefore provided enhanced cooling effects for the outer pane 260'.

Figure 4:
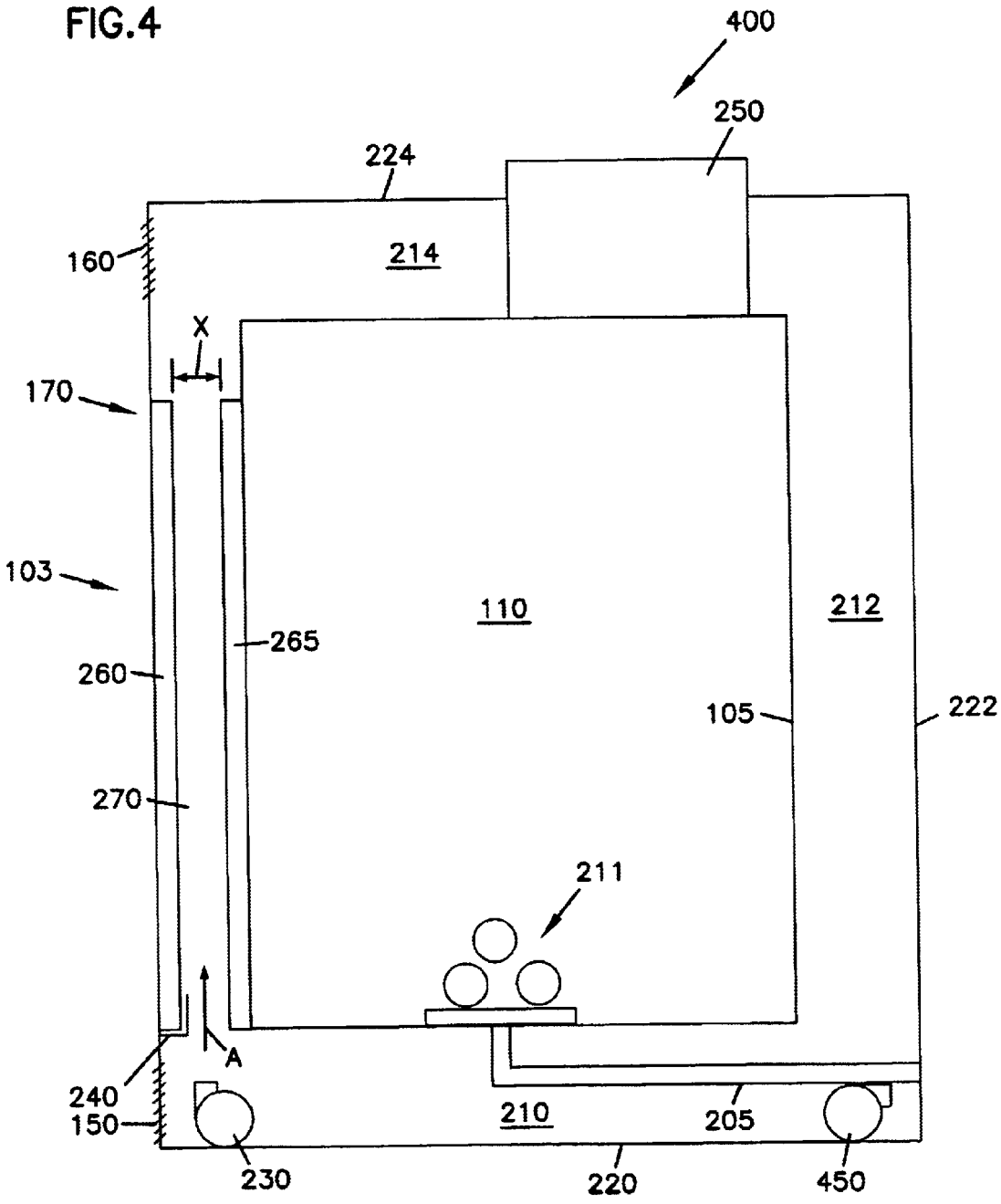
FIG. 4 is a schematic side cross-sectional view of a fireplace including a third embodiment of an example cooling apparatus made in accordance with the present invention.
Figure 5:
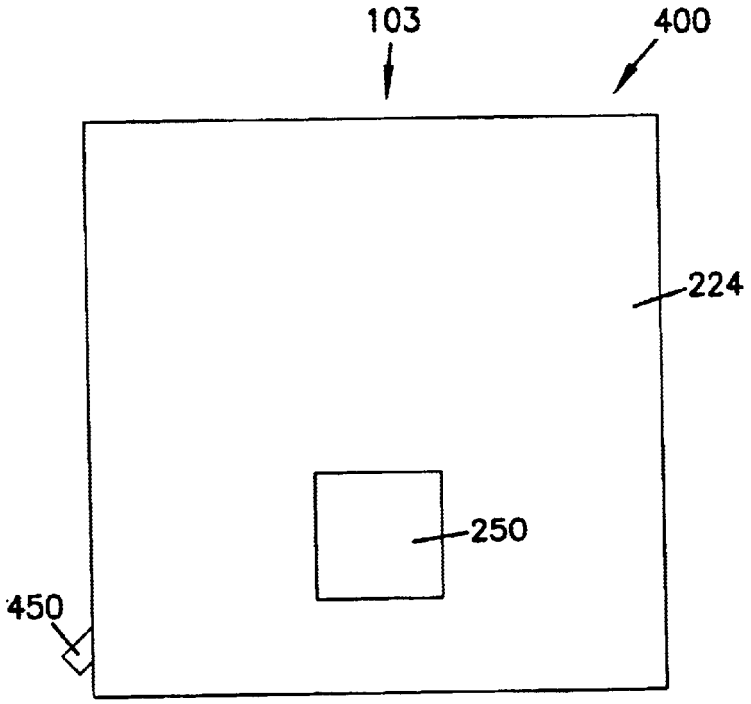
FIG. 5 is a schematic top view of the fireplace of FIG. 4.

A third embodiment of a fireplace 400 is shown in FIGS. 4 and 5. Fireplace 400 is similar to fireplace 100, except that an additional blower 450 is positioned at a back portion of the lower plenum 210. This additional blower 450, as shown in FIG. 5, actually extends out of the fireplace 400 and functions to draw room air that has been warmed out of the fireplace 400. The warmed room air may be channeled from the blower 450 to, for example, another portion of the house where heat is desirable. In this manner, the blower 450 may further reduce an amount of heat in the fireplace 400, further cooling the viewing surface 103 and surround 106. The blower 450 can be used with or without a second blower such as blower 230.

Figure 6:
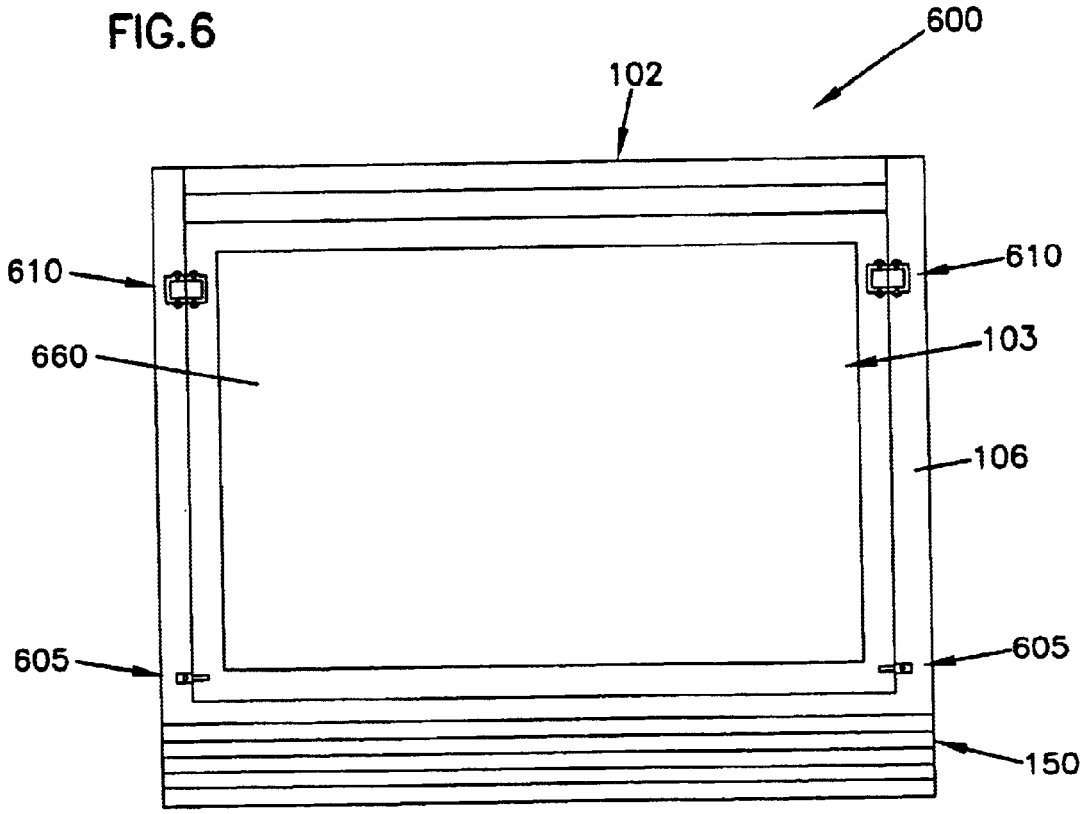
FIG. 6 is a schematic front view of another example embodiment of a fireplace including an example cooling apparatus made in accordance with the present invention.
Figure 7:
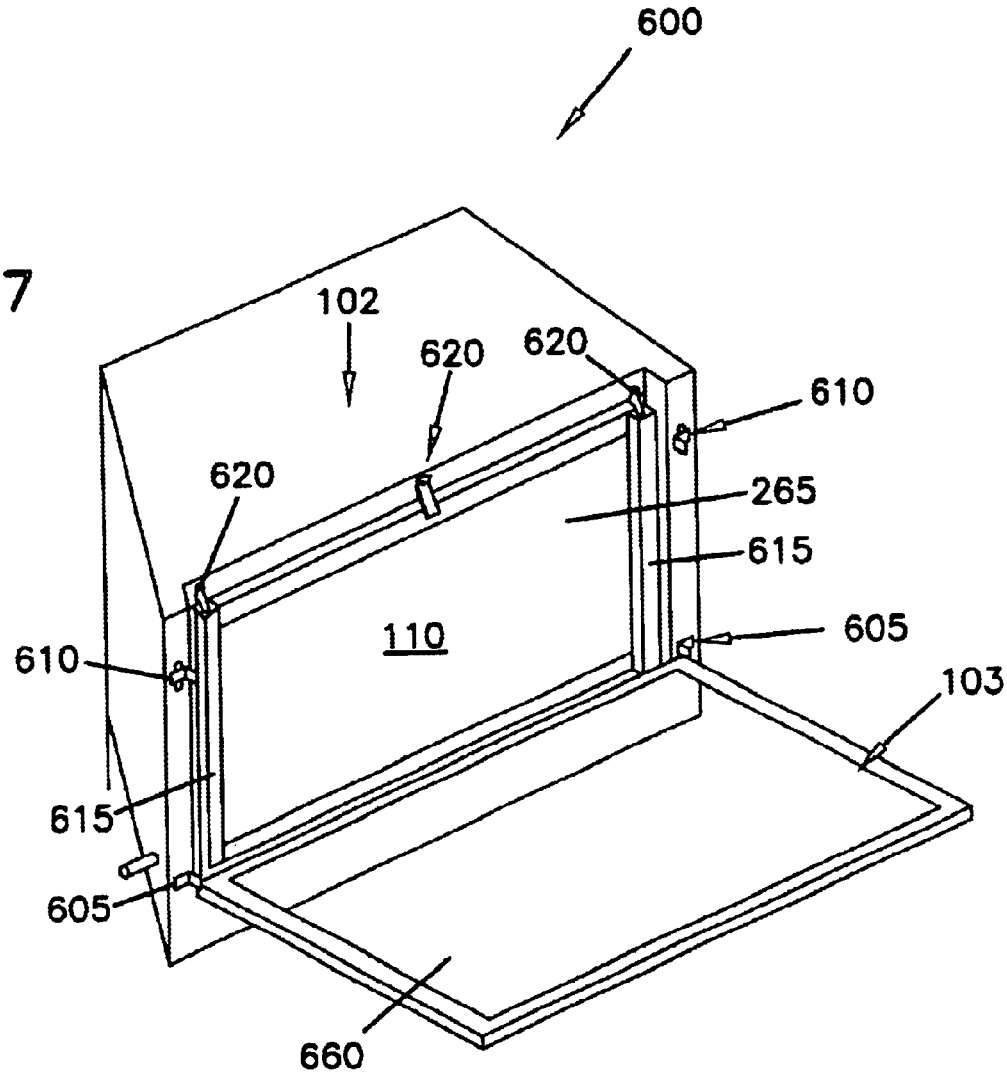
FIG. 7 is a perspective view of the fireplace of FIG. 6 with an outside pane pivoted to an open position.

There are many modifications that can be made to the inventive cooling apparatus disclosed herein. For example, referring now to FIGS. 6 and 7, another example embodiment of a fireplace 600 is illustrated. The fireplace 600 may be configured in a manner similar to fireplaces 100, 300, or 400 above, except that an outer pane 660 is coupled to the fireplace 600 by hinges 605 and clips 610. The clips 610 releasably attach an upper end of the outer pane 660 to the fireplace 600, and the hinges 605 allow the outer pane 660 to pivot open, as shown in FIG. 7. Spacers 615 may be used to maintain the desired gap between the outer pane 660 and the inner pane 265, the inner pane 265 being coupled to the fireplace 600 using brackets 620. It may be desirable to configure the fireplace 600 with the pivoting outer pane 660 so that access is provided to the inner pane 265 to, for example, conduct maintenance on the fireplace 600 or to clean the inner pane 265.

In another embodiment, the outer pane 660 may be removed completely, and the inner pane 265 may be maintained at a cooler temperature by the air blown over the inner pane 265 by one or more blowers located below or above the inner pane 265.

Figure 8:
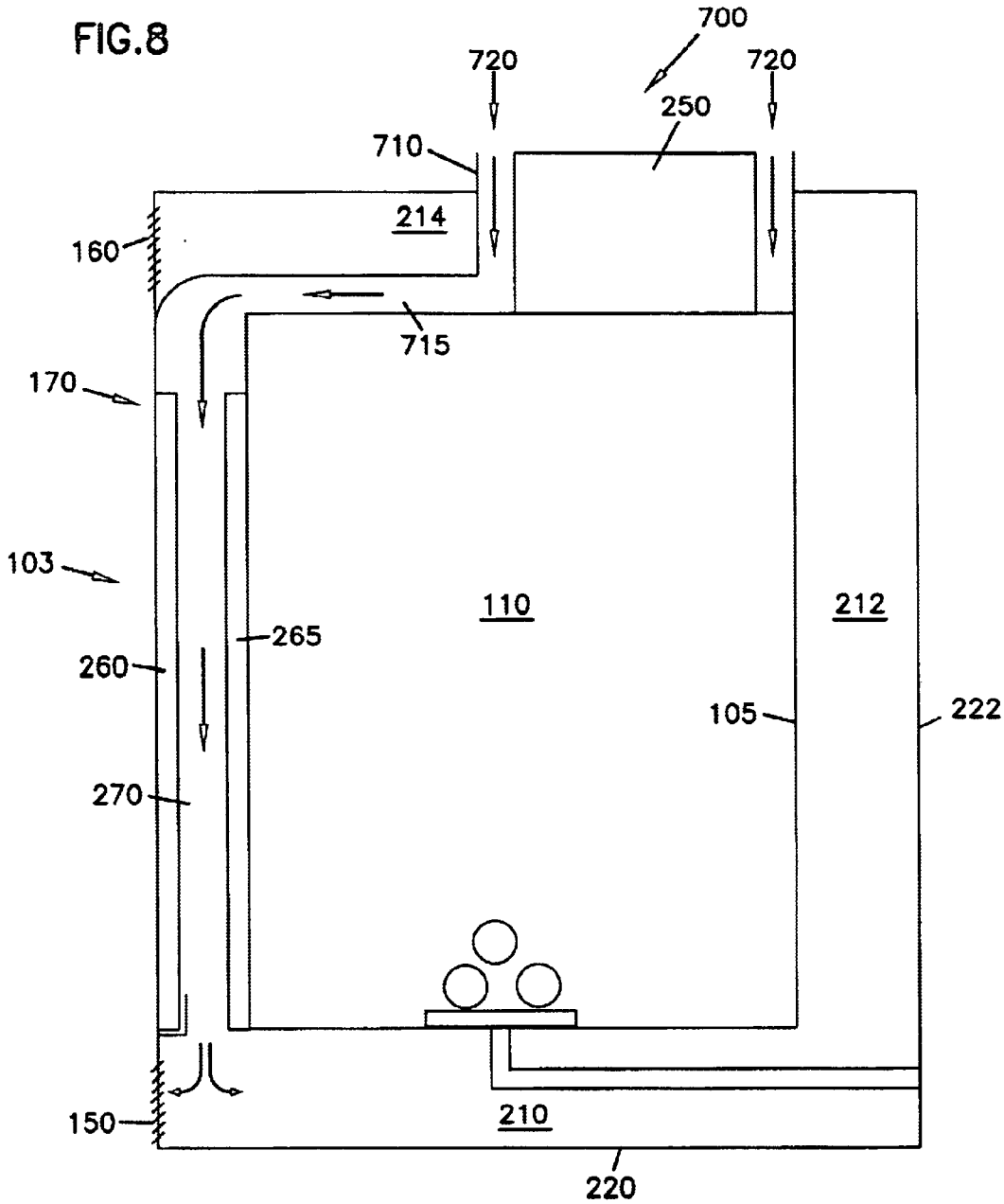
FIG. 8 is a schematic side cross-sectional view of an example fireplace including a fourth embodiment of an example cooling apparatus made in accordance with the present invention.

In another embodiment, it is possible to provide fresh air rather than room air, to move through the space 270. Another example embodiment of a fireplace 700 is shown in FIG. 8. The fireplace 700 may be configured in a manner similar to fireplaces 100, 300, 400, or 600 above, except that fireplace 700 includes a fresh air intake 720 configured to provide fresh air to the fireplace 700. Fresh air may be, for example, air provided from an exterior of a structure.

The fresh air intake 720 includes a panel 710 defining a plenum 715 through which the fresh air flows and is directed through the space 270, as indicated by the arrows. As the fresh air flows out of the space 270, the fresh air may be exhausted out the vent 150 or enter the lower plenum 210. The fresh air functions to maintain the outer pane 260 at a cooler temperature.

Figure 9:
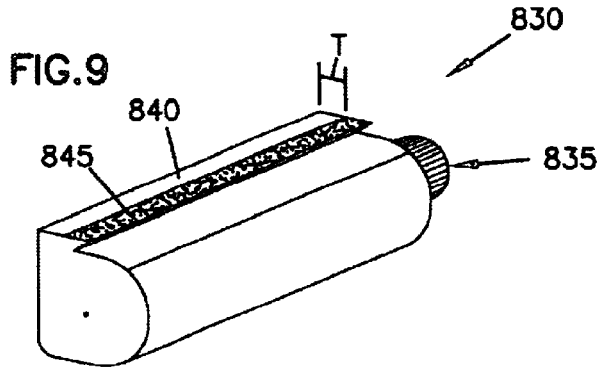
FIG. 9 is a perspective view of an example embodiment of a blower including a flow restrictor made in accordance with the present invention.

Other design configurations and modifications may be used to optimize the cooling effect for the outer pane. For example, referring now to FIGS. 9 and 10, an example blower 830 is shown including an air intake 835 and an air exhaust 840. A flow restrictor 845 is positioned at the air exhaust 840 to restrict a size T of the exhaust through which air may flow, as indicated by arrows 850. In the example embodiment shown, the size T is about 1 inch, although other dimensions are possible.

Figure 10:
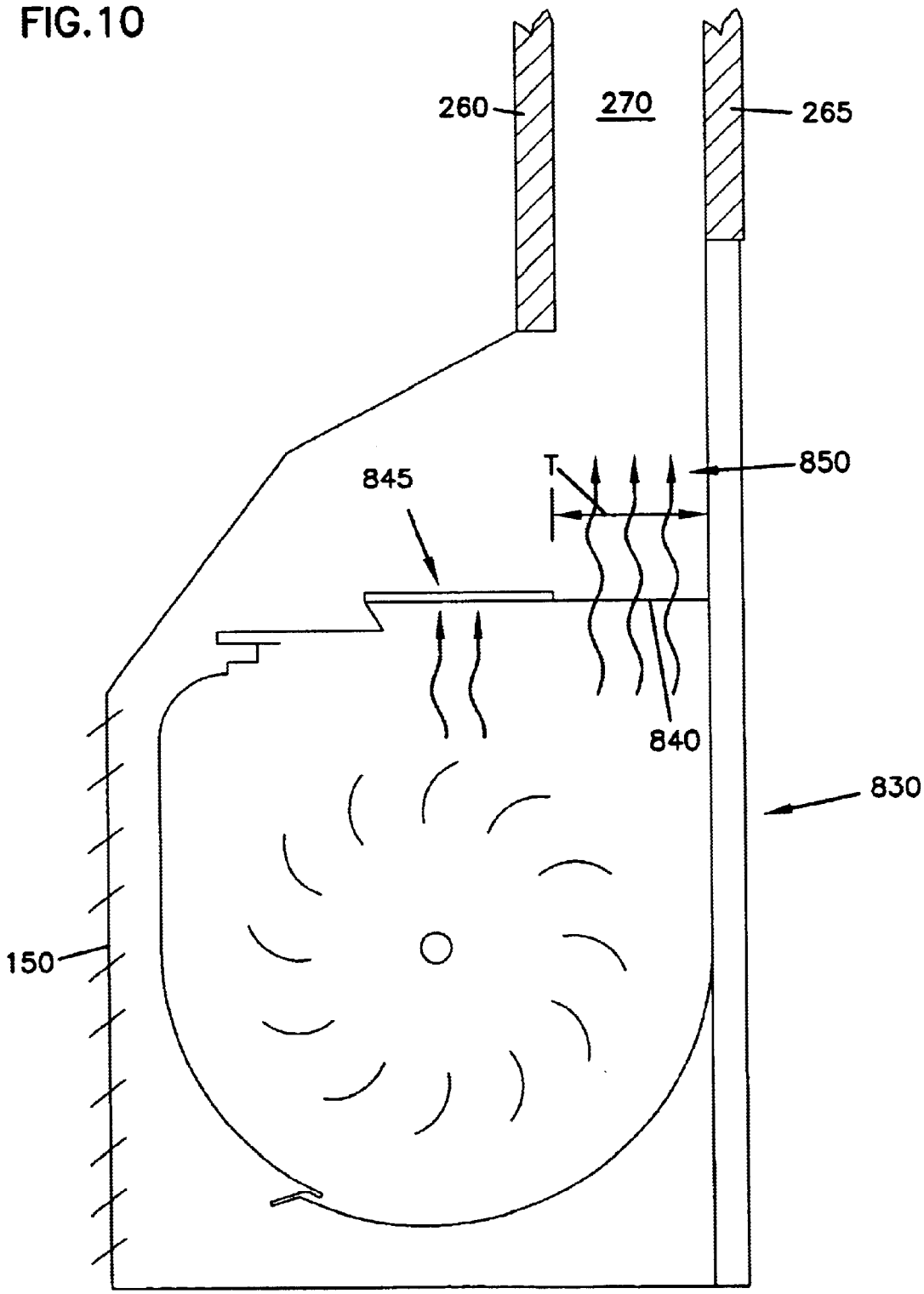
FIG. 10 is a schematic side cross-sectional view of the blower of FIG. 9.
Figure 11:
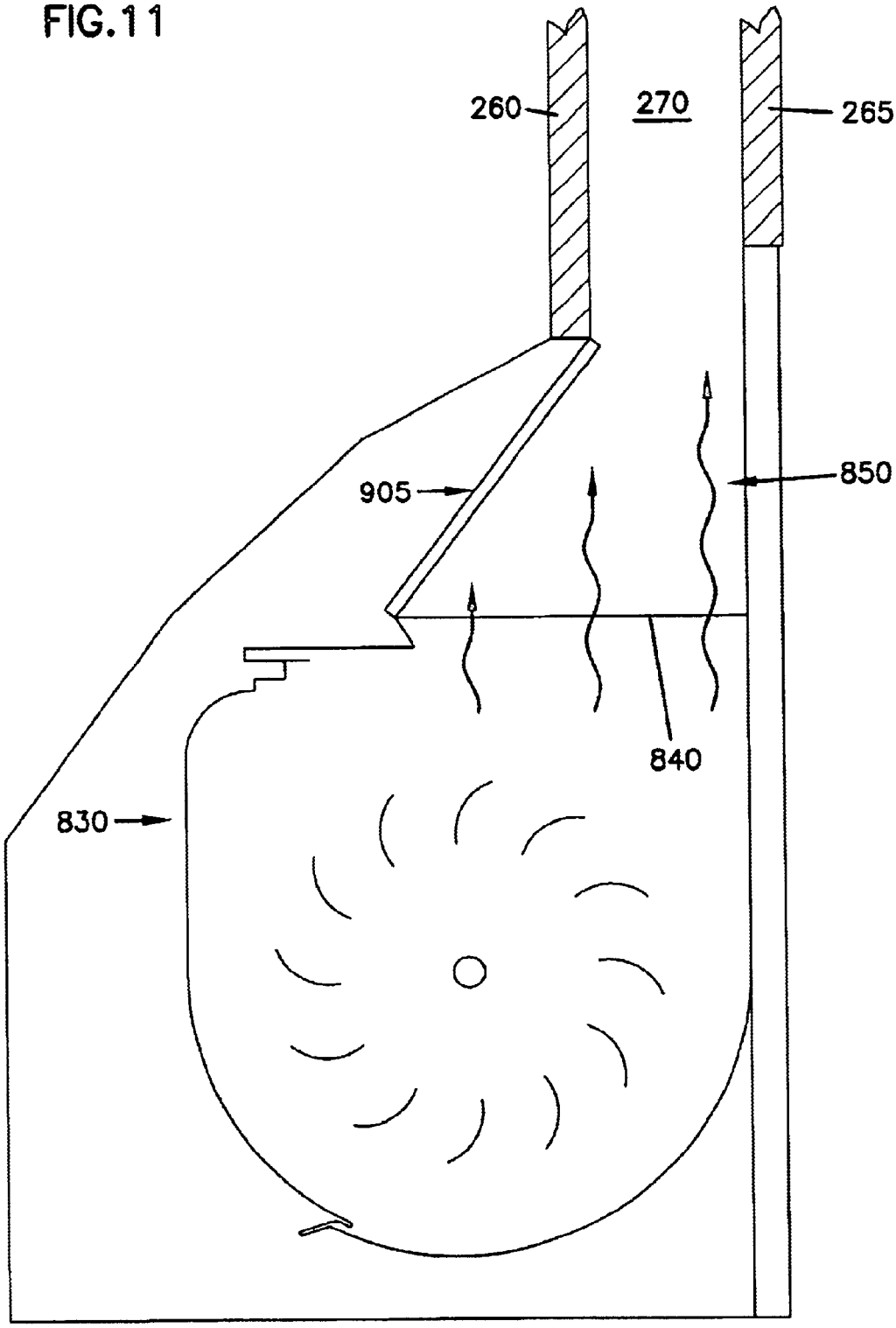
FIG. 11 is a schematic side cross-sectional view of another example embodiment of a blower including a baffle made in accordance with the present invention.

In FIG. 10, instead of using the flow restrictor 845, a baffle 905 is positioned at an angle with respect to the air exhaust 840 to channel the air into the space 720.

It may be desirable to use the flow restrictor 845 and/or the baffle 905 to reduce turbulence associated with the air that is exhausted out of the blower 830 and into the space 270. In this manner, the cooling effect on the outer pane 260 may be optimized.

Figure 12:
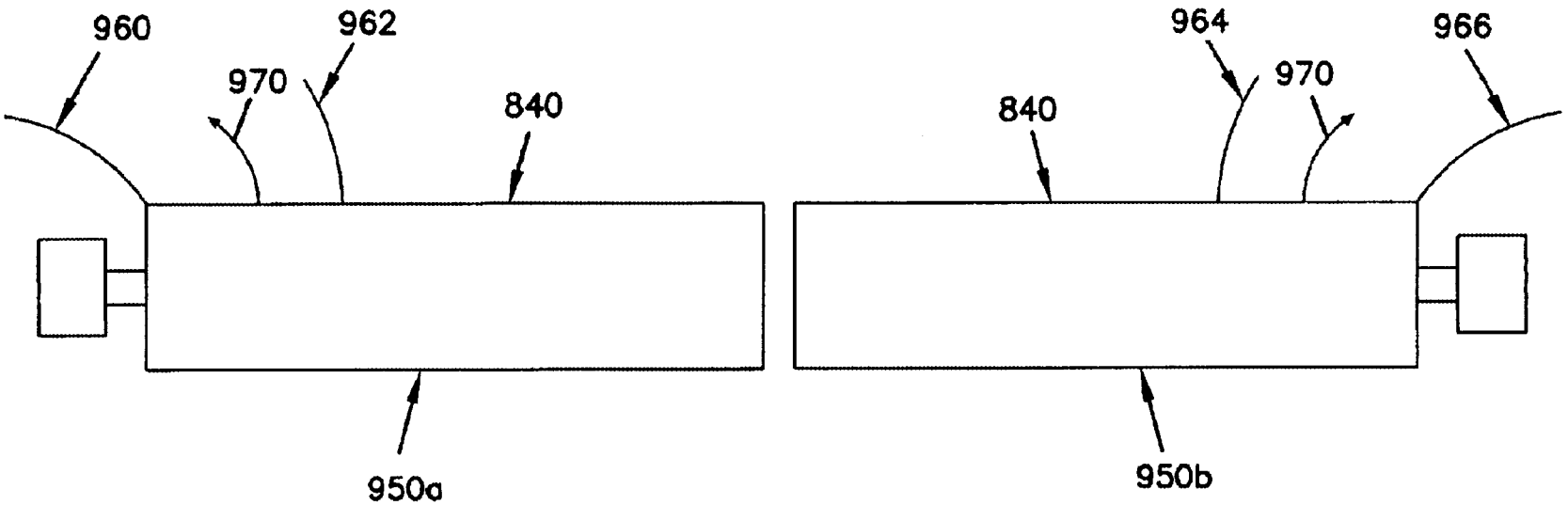
FIG. 12 is a front schematic view of an example embodiment including two blowers with example flow directors made in accordance with the present invention.

In yet another embodiment, shown in FIG. 12, dual blowers 950*a* and 950*b* are illustrated (one blower or more than two may also be used). Each blower 950*a* and 950*b* includes flow directors 960, 962, 964, and 966 positioned to direct the flow of air that is exhausted out of the air exhausts 840 by the blowers 950*a* and 950*b*. The flow directors 960, 962, 964, and 966 are positioned to provide air flow through the space between the outer and inner panes that is substantially uniform over the surface of the outer pane so that localized "hot spots" are minimized on the outer pane. For example, the flow directors 960, 962, 964, and 966 may be used to direct air to the outer corners of the outer pane to optimize the cooling effect.

A combination of one or more of the flow restrictor 845, baffle 905, and/or flow directors 960, 962, 964, and 966 may also be used.

Further, the dimensions X or Y and Z defining the gap between the outer and inner panes can be varied depending on such factors as the heat generated in the combustion chamber and the power and capacity of the one or more blowers. For example, depending on the heat generated, it may be desirable to adjust the power and/or capacity of the one or more blowers to minimize the convection of heat from the inner pane to the outer pane.

In addition, in other variations, instead of pushing air through the space 270 using the blowers 230 and/or 830, it is possible use a blower to draw air through the space, or, alternatively, allow the air to naturally convect through the space 270. In addition, more than one blower may be positioned, in parallel or series fashion, to blow or draw air through the space. Further, it is possible to locate the blower outside of the fireplace, such as in an adjacent wall, to move air through the fireplace and the space 270 to create the cooling effect.

In another alternative embodiment, refrigerated air may be moved through the space between the inner and outer panes. Refrigerated air may be air that is cooled using, for example, an air conditioner. In one example embodiment, a miniature air conditioner is located within the outer enclosure of a fireplace to provide refrigerated air to flow through the space. In other embodiments, refrigerated air may be obtained from other sources, such as a standard air conditioner for a structure. In this manner, the refrigerated air flowing through the space may further cool the outer pane.

It is also possible to modify the cooling apparatus itself. For example, the two panes that define the space 270 may be rounded in shape, or may be integrally formed as a single pane including the space 270. For example, for a fireplace including a view surface that completely surrounds the combustion chamber, the panes may be formed as two round panes that fit inside one another concentrically to form the space 270.

The present invention should not be considered limited to the particular examples or materials described above, but rather should be understood to cover all aspect of the invention as fairly set out in the attached claims. Various modifications, equivalent processes, as well as numerous structures to which the present invention may be applicable will be readily apparent to those of skill in the art to which the present invention is directed upon review of the instant specification.

What is claimed is:

1. A fireplace including a cooling apparatus for cooling a viewing surface of the fireplace, the fireplace comprising:

an outer enclosure;

a combustion chamber enclosure defining an opening, the combustion chamber being disposed within the outer enclosure;

a burner coupled to a source of combustible gas, the burner combusting the combustible gas to generate flames and heat, and the burner being positioned at least partially within the combustion chamber enclosure;

an inner pane positioned to at least partially cover the opening of the combustion chamber enclosure and to be at least partially disposed within the outer enclosure;

an outer pane spaced about one inch apart from the inner pane to define a space through which room air moves, the space being configured to maximize cooling of the outer pane;

a plenum system defined between the outer enclosure and the combustion chamber enclosure, the plenum system being configured to move room air through the plenum system to heat the room air; and a blower positioned to move room air through the space between the inner pane and the outer pane, the blower being disposed in the plenum system.

2. The fireplace of claim 1, wherein a lower distance between a lower end of the outer pane and a lower end of the inner pane is greater than an upper distance between an upper end of the outer pane and an upper end of the inner pane.

3. The fireplace of claim 2, wherein the lower distance is between about ⅝ inch and about ¾ inch and the upper distance is between about 1/16 inch and about ⅛ inch.

4. The fireplace of claim 1, wherein the inner pane and the outer pane include tempered glass.

5. The fireplace of claim 1, wherein a second blower is positioned to draw warm air out of the fireplace to further cool the outer pane.

6. The fireplace of claim 1, wherein the outer pane is configured to be pivotable with respect to the inner pane between a closed position and an open position.

7. The fireplace of claim 1, wherein the blower includes a flow restrictor to reduce turbulence.

8. The fireplace of claim 1, wherein the blower includes a baffle to reduce turbulence.

9. The fireplace of claim 1, wherein the blower includes at least one flow director to direct the room air to optimize cooling over a portion of the outer pane.

10. The fireplace of claim 1, wherein the outer pane is maintained at a temperature not greater than approximately 170 degrees Fahrenheit.

11. A fireplace including a cooling apparatus for cooling a viewing surface of the fireplace, the fireplace comprising:

a combustion chamber enclosure defining an opening;

an inner pane positioned to at least partially cover the opening of the combustion chamber;

an outer pane spaced apart from the inner pane to define a space through which air moves, wherein a lower distance between a lower end of the outer pane and a lower end of the inner pane is greater than an upper distance between an upper end of the outer pane and an upper end of the inner pane;

a blower positioned to move the air through the space between the inner pane and the outer pane; and another blower positioned to draw warm air out of the fireplace to further cool the outer pane.

* * * * *